US008197287B2

(12) United States Patent
Rosenberger

(10) Patent No.: US 8,197,287 B2
(45) **Date of Patent: *Jun. 12, 2012**

(54) AXIALLY ADJUSTABLE COAXIAL COUPLING

(75) Inventor: Bernd P. Rosenberger, Tittmoning (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 37 days.

This patent is subject to a terminal disclaimer.

(21) Appl. No.: 12/664,119

(22) PCT Filed: Jun. 2, 2008

(86) PCT No.: PCT/EP2008/004377

§ 371 (c)(1),
(2), (4) Date: Dec. 11, 2009

(87) PCT Pub. No.: WO2009/000386

PCT Pub. Date: Dec. 31, 2008

(65) Prior Publication Data

US 2010/0297867 A1 Nov. 25, 2010

(30) Foreign Application Priority Data

Jun. 25, 2007 (DE) ..... 20 2007 008 848 U

(51) Int. Cl.
*H01R 24/00* (2011.01)

(52) U.S. Cl. ..... 439/675

(58) Field of Classification Search ..... 439/445, 439/638, 675, 578; 333/32, 33
See application file for complete search history.

(56) References Cited

U.S. PATENT DOCUMENTS

| | | | | |
|---|---|---|---|---|
| 3,315,184 | A * | 4/1967 | Wood | 333/241 |
| 3,416,125 | A | 12/1968 | Theve | |
| 4,915,651 | A * | 4/1990 | Bout | 439/578 |
| 2004/0029433 | A1 | 2/2004 | Lee et al. | |

FOREIGN PATENT DOCUMENTS

| | | | |
|---|---|---|---|
| CH | 460 110 | A | 7/1968 |
| DE | 15 40 373 | A1 | 1/1970 |
| DE | 15 91 440 | B1 | 4/1970 |

* cited by examiner

*Primary Examiner* — Vanessa Girardi
(74) *Attorney, Agent, or Firm* — DeLio & Peterson, LLC; Robert Curcio

(57) ABSTRACT

A coaxial connector having an outer conductor with first and second plug-side ends axially opposite, and an inner conductor with first and second plug-side ends axially opposite. The outer conductor has two separate outer conductor parts arranged and configured such that they are mobile relative to each other in the axial direction, the outer conductor being configured as an outer conductor bellows between the two outer conductor parts. An elastic spring element is provided on the outer conductor and acts upon the two outer conductor parts, driving them away from each other. A change in length of the outer conductor bellows changes capacitance of the outer conductor bellows and is compensated by a correspondingly changing opposite inductance such that the characteristic impedance of the coaxial connector remains substantially constant.

12 Claims, 2 Drawing Sheets

AXIALLY ADJUSTABLE COAXIAL COUPLING

CROSS REFERENCE TO RELATED APPLICATION

This application is a National Phase filing under 35 U.S.C. §371 of PCT/EP/2008/004377 which was filed Jun. 2, 2008, and claims priority to German Application No. DE 20 2007 008 848.5 filed Jun. 25, 2007.

BACKGROUND OF THE INVENTION

1. Field of the Invention

The invention relates to a coaxial connector having an outer conductor which has a first end for insertion, and a second end for insertion in an axially opposite position from the first end for insertion of the outer conductor, and having a center conductor which has a first end for insertion, and a second end for insertion in an axially opposite position from the first end for insertion of the center conductor, as defined in the preamble to claim 1.

2. Description of Related Art

Known from DE 10 2004 044 975 A1 is a coaxial connecting part, having an outer-conductor sleeve and a center conductor, for connecting a coaxial socket to a circuit carrier. Arranged in the center conductor is a resiliently yielding bellows made of a conductive material to keep axial and radial forces which arise on entry to the socket away from the circuit carrier. The resilient bellows is for example producing by applying a thin layer of nickel to an aluminum blank by electroplating. Despite the resilient bellows, the connecting part can be produced to give low reflection. The outline shape of the bellows is so selected that the preset standard resistance of, for example, 50Ω exists in the coaxial outer-conductor sleeve even at the point where the bellows is situated. This can be calculated and applied with the help of a 3D simulator for radio-frequency electromagnetic problems.

Known from DE 199 26 483 A1 is a coaxial interface in which a displaceable attenuating sleeve in the form of a bellows structure is arranged on an outer conductor. This attenuating sleeve is so designed that, when the connecting means is withdrawn, the outer conductor, together with the bellows structure, produces wave-guide attenuation with a lower limiting frequency of attenuation of, for example 20 GHz, thus enabling the mechanically open RF connection to be considered screened and terminated from the electrical point of view. There is not however any change in the electrical and mechanical properties when the coaxial interface is connected by insertion. On the contrary, an outer conductor sleeve is provided which makes mechanical and electric contact in the inserted state and therefore puts the bellows structure out of action electrically when in the inserted state.

SUMMARY OF THE INVENTION

Bearing in mind the problems and deficiencies of the prior art, it is therefore an object of the present invention to improve a coaxial connector of the above kind in respect of its frequency-related behavior and its safety and reliability of operation.

This object is achieved in accordance with the invention by a coaxial connector of the above kind which has the features given in the characterizing clause of claim 1.

Still other objects and advantages of the invention will in part be obvious and will in part be apparent from the specification.

The above and other objects, which will be apparent to those skilled in the art, are achieved in the present invention which is directed to a coaxial connector having an outer conductor which has a first end for insertion, and a second end for insertion in an axially opposite position from the first end for insertion of the outer conductor, and having a center conductor which has a first end for insertion, and a second end for insertion in an axially opposite position from the first end for insertion of the center conductor, the outer conductor comprising two separate parts, with a first outer-conductor part forming the first end for insertion of the outer conductor and a second outer-conductor part forming the second end for insertion of the outer conductor, the two parts of the outer conductor being so arranged and designed that they can be moved relative to one another in the axial direction, there being provided on the outer conductor a first elastic resilient member which forces the two outer-conductor parts of the outer conductor away from one another in the axial direction, the center conductor comprising two separate parts, with a first center-conductor part forming the first end for insertion of the center conductor and a second center-conductor part forming the second end for insertion of the center conductor, the two parts of the center conductor being so arranged and designed that they can be moved relative to one another in the axial direction, characterized in that the outer conductor takes the form, between the two outer-conductor parts, of a resilient outer-conductor bellows, the resilient outer-conductor bellows being so designed that, if there is a change in the length of the resilient outer-conductor bellows, a varying capacitance of the resilient outer-conductor bellows is compensated for by an inductance of the resilient outer-conductor bellows which varies correspondingly in the opposite direction, in such a way that, if there is a change in the length of the resilient outer-conductor bellows, the characteristic impedance of the coaxial connector remains substantially constant, the center conductor taking the form, between the two center-conductor parts, of a resilient center-conductor bellows, the resilient center-conductor bellows being so designed that, if there is a change in the length of the resilient center-conductor bellows, a varying capacitance of the resilient center-conductor bellows is compensated for by an inductance of the resilient center-conductor bellows which varies correspondingly in the opposite direction, in such a way that, if there is a change in the length of the resilient center-conductor bellows, the characteristic impedance of the coaxial connector remains substantially constant.

The first elastic resilient member includes a coil spring. A first stop is provided for limiting the movement of the two outer-conductor parts away from one another in the axial direction. An outer-conductor sleeve fits around the two outer-conductor parts and includes second stops to limit axial movement of the two outer-conductor parts away from one another.

The first center-conductor part is movable in the axial direction relative to the first outer-conductor part and the second center-conductor part is movable in the axial direction relative to the second outer-conductor part, wherein the center conductor includes a second elastic resilient member which forces the two parts of the center conductor away from one another in the axial direction.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
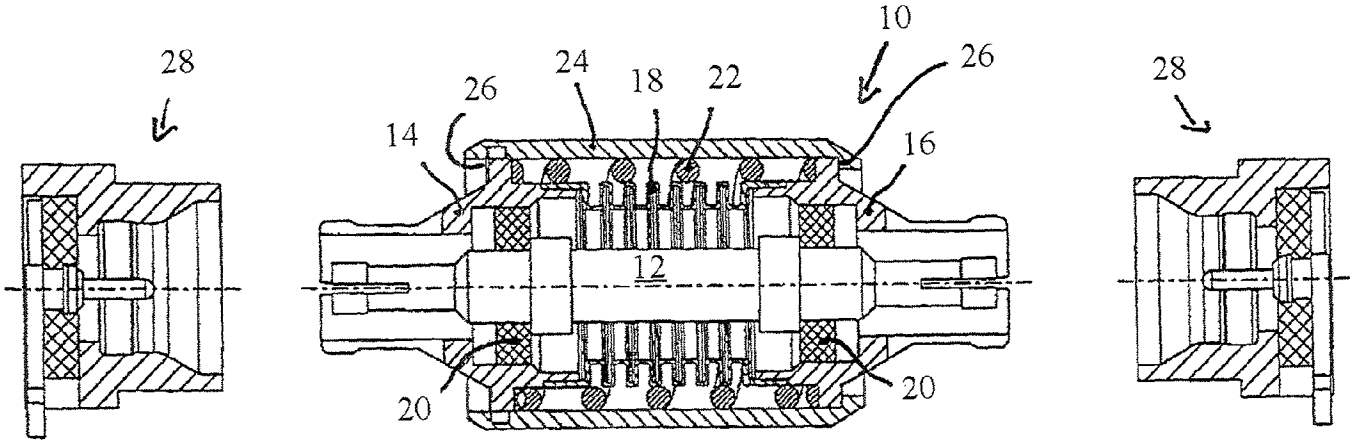
FIG. 1 is a view in section of a first preferred embodiment of coaxial connector according to the invention.

In describing the preferred embodiment of the present invention, reference will be made herein to FIGS. 1-3 of the drawings in which like numerals refer to like features of the invention.

In a coaxial connector of the above kind, provision is made in accordance with the invention for the outer conductor to comprise two separate parts, with a first outer-conductor part forming the first end for insertion of the outer conductor and a second outer-conductor part forming the second end for insertion of the outer conductor, the two parts of the outer conductor being so arranged and designed that they can be moved relative to one another in the axial direction, the outer conductor taking the form, between the two outer-conductor parts, of a resilient outer-conductor bellows, there being provided on the outer conductor a first elastic resilient member which forces the two parts of the outer conductor away from one another in the axial direction, the resilient outer-conductor bellows being so designed that, if there is a change in the length of the resilient outer-conductor bellows, a varying capacitance of the resilient outer-conductor bellows is compensated for by an inductance of the resilient outer-conductor bellows which varies correspondingly in the opposite direction, in such a way that, if there is a change in the length of the resilient outer-conductor bellows, the characteristic impedance of the coaxial connector remains substantially constant.

This has the advantage that a coaxial connector for RF applications at frequencies above 20 GHz, is available which has a means of compensating for length in the outer conductor, the electrical and mechanical properties of the coaxial connector not being adversely affected even if there is a change in the length of the outer conductor but being, on the contrary, improved over a wide frequency range.

The two parts of the outer conductor are usefully so arranged and designed that they can each be moved in the axial direction relative to the center conductor.

The first elastic resilient member is for example a coil spring.

A first stop is usefully provided which limits the movement of the two outer-conductor parts away from one another in the axial direction.

In a preferred embodiment, an outer-conductor sleeve is provided which fits round the two outer-conductor parts and which has second stops which limit an axial movement of the two outer-conductor parts away from one another.

So that there is also a means of compensating for length or tolerances available in the case of the center conductor, thus producing other, additional improvements in the electrical properties of the coaxial connector, the center conductor comprises two separate parts, with a first center-conductor part forming the first end for insertion of the center conductor and a second center-conductor part forming the second end for insertion of the center conductor, the two parts of the center conductor being so arranged and designed that they can be moved relative to one another in the axial direction, the center conductor taking the form, between the two center-conductor parts, of a resilient center-conductor bellows, the resilient center-conductor bellows being so designed that, if there is a change in the length of the resilient center-conductor bellows, a varying capacitance of the resilient center-conductor bellows is compensated for by an inductance of the resilient outer-conductor bellows which varies correspondingly in the opposite direction, in such a way that, if there is a change in the length of the resilient center-conductor bellows, the characteristic impedance of the coaxial connector remains substantially constant.

A contacting force which is independent of the outer-conductor parts is obtained at the opposite ends for insertion of the center conductor by virtue of the fact that the first center-conductor part is movable in the axial direction relative to the first outer-conductor part and the second center-conductor part is movable in the axial direction relative to the second outer-conductor part, there being provided on the center conductor a second elastic resilient member which forces the two parts of the center conductor away from one another in the axial direction.

In a preferred embodiment the second elastic resilient member is a coil spring.

A stop is usefully provided which limits the movement of the two center-conductor parts away from one another in the axial direction.

In an illustrative embodiment the first center-conductor part is rigidly connected to the first outer-conductor part and the second center-conductor part is rigidly connected to the second outer-conductor part.

Figure 2:
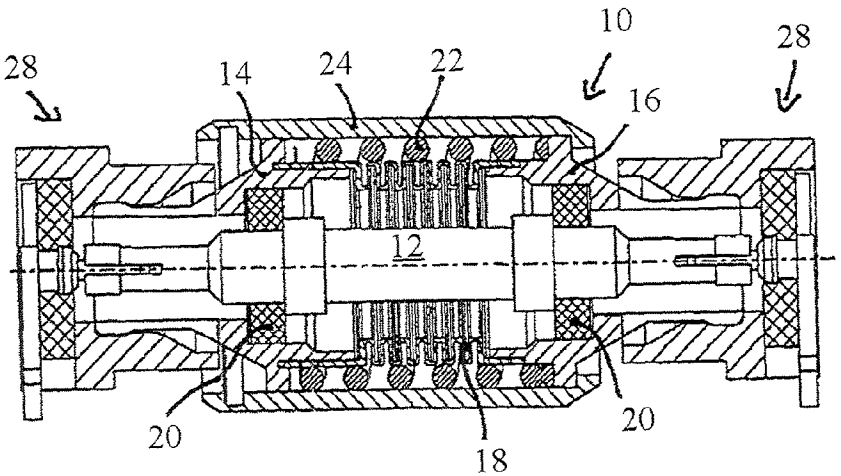
FIG. 2 shows the coaxial connector according to the invention in the inserted state.

The first preferred embodiment of coaxial connector 10 according to the invention which is shown in FIGS. 1 and 2 comprises a center conductor 12, and an outer conductor which is made up of a first outer-conductor part 14 which forms a first end for insertion of the outer conductor and a second outer-conductor part 16 which forms a second end for insertion of the outer conductor. Between the two outer-conductor parts 14, 16, the outer conductor takes the form of a resilient outer-conductor bellows 18. In this way, the two outer-conductor parts 14, 16 are able to move relative to one another in the axial direction. The center conductor 12 is of a rigid form, the center conductor 12 being held within the two outer-conductor parts 14, 16 by insulating discs 20 in such a way that the two outer-conductor parts 14, 16 are able to move relative to the center conductor 12 in the axial direction. Also provided is a coil spring 22 which is so arranged and designed that the coil spring 22 presses the two outer-conductor parts 14, 16 away from one another in the axial direction.

The two outer-conductor parts 14, 16 are surrounded by an outer-conductor sleeve 24 which guides the two outer-conductor parts 14, 16 in the axial direction and forms stops 26 which limit an axial movement of the two outer-conductor parts 14, 16 away from one another. The coil spring 22 is fitted in the outer-conductor sleeve 24 under a pre-loading, thus causing the coil spring 22 to press the two outer-conductor parts 14, 16 against the stops 26 when the coaxial connector is in the un-inserted state, as shown in FIG. 1.

Also shown in FIGS. 1 and 2 are complementary coaxial connectors 28 which are designed to mate with the first and second ends for insertion respectively of the coaxial connector.

In the inserted state, as shown in FIG. 2, the coil spring 22 presses the two parts 14, 16 of the outer conductor against the contact-making surfaces of the complementary coaxial connectors 28 and thereby makes good mechanical and electrical contact between the coaxial connector 10 according to the invention and the complementary coaxial connectors 28.

The resilient outer-conductor bellows 18 is so designed in this case that it provides a means of compensating for length and tolerances by a corresponding change in length, a varying capacitance of the resilient outer-conductor bellows 18 if there is a change in the length of the resilient outer-conductor bellows 18 being compensated for by an inductance of the resilient outer-conductor bellows 18 which varies correspondingly in the opposite direction, in such a way that if there is a change in the length of the resilient outer-conductor bellows 18 the characteristic impedance of the coaxial connector 10 remains substantially constant.

The coil springs 22 on the outer-conductor part absorbs the mechanical insertion forces. However, because current flows through the resilient outer-conductor bellows 18 and not through the coil spring, the electrical conduction is thus separated from the mechanical stress in a particularly advantageous way.

Figure 3:
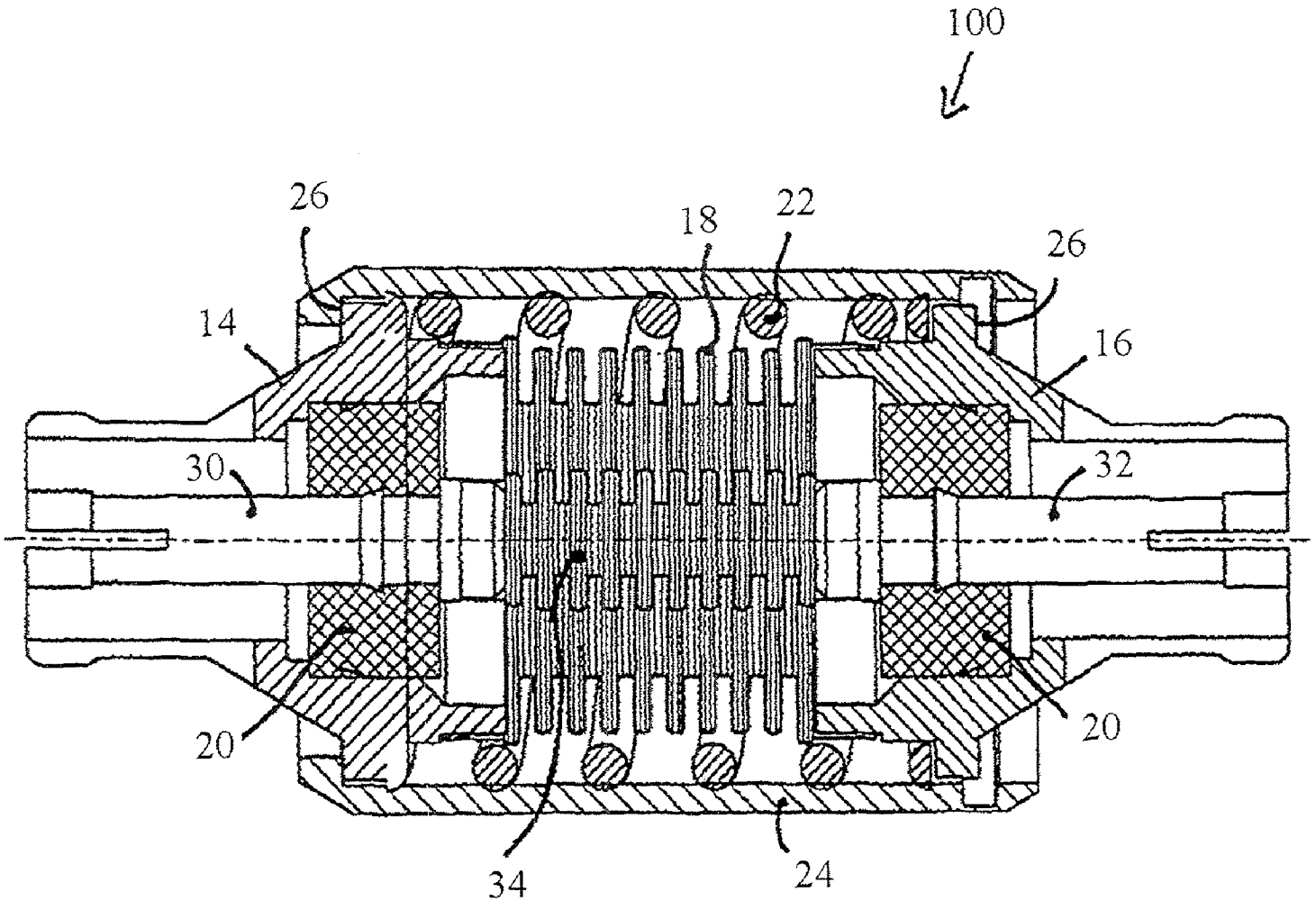
FIG. 3 is a view in section of a second preferred embodiment of coaxial connector according to the invention.

FIG. 3 shows a second preferred embodiment of coaxial connector 100 according to the invention, parts which perform the same function being identified by the same reference numerals as in FIGS. 1 and 2, which means that for an explanation of these parts reference should be made to the above description of FIGS. 1 and 2. In contrast to the first embodiment shown in FIGS. 1 and 2, the center conductor too is made up, in two parts, of a first center-conductor part 30 and a second center-conductor part 32, the center conductor taking the form, between the two center-conductor parts 30, 32, of a resilient center-conductor bellows 34. The two center-conductor parts 30, 32 are held by the insulating discs 20 to be rigid or movable relative to the two outer-conductor parts 14, 16, i.e. the first center-conductor part 30 is rigidly or movably connected to the first outer-conductor part 14 by means of the insulating disc 20 and the second center-conductor part 32 is rigidly or movably connected to the second outer-conductor part 16 by means of the insulating disc 20. Because of this there is available, on the center conductor too, a means of compensating for length and tolerances when the coaxial connector 100 is inserted. In the event of the outer-conductor parts 14, 16 and center-conductor parts 30, 32 being movable relative to one another, a second coil spring (not shown) is advantageously arranged in addition on the central conductor, in such a way that this coil spring presses the two center-conductor parts 30, 32 away from one another. This gives a means of compensating for length and tolerances which is independent of the outer conductor.

Like the resilient outer-conductor bellows 18, the resilient center-conductor bellows 34 too is so designed that it provides a means of compensating for length and tolerances by an corresponding change in length, a varying capacitance of the resilient center-conductor bellows 34 being compensated for by an inductance of the resilient center-conductor bellows 34 which varies correspondingly in the opposite direction if there is a change in the length of the resilient center-conductor bellows 34, in such a way that, if there is a change in the length of the resilient center-conductor bellows 34, the characteristic impedance of the coaxial connector 100 remains substantially constant.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. Coaxial connector having an outer conductor which has a first end for insertion, and a second end for insertion in an axially opposite position from the first end for insertion of the outer conductor, and having a center conductor which has a first end for insertion, and a second end for insertion in an axially opposite position from the first end for insertion of the center conductor, the outer conductor comprising two separate parts, with a first outer-conductor part forming the first end for insertion of the outer conductor and a second outer-conductor part forming the second end for insertion of the outer conductor, the two parts of the outer conductor being so arranged and designed that they can be moved relative to one another in the axial direction and to move in the axial direction relative to the center conductor, and there being provided on the outer conductor a first elastic resilient member which forces the two outer-conductor parts of the outer conductor away from one another in the axial direction, the center conductor comprising two separate parts, with a first center-conductor part forming the first end for insertion of the center conductor and a second center-conductor part forming the second end for insertion of the center conductor, the two parts of the center conductor being so arranged and designed that they can be moved relative to one another in the axial direction, characterized in that the outer conductor takes the form, between the two outer-conductor parts, of an resilient outer-conductor bellows, the resilient outer-conductor bellows being so designed that, if there is a change in the length of the resilient outer-conductor bellows, a varying capacitance of the resilient outer-conductor bellows is compensated for by an inductance of the resilient outer-conductor bellows which varies correspondingly in the opposite direction, in such a way that, if there is a change in the length of the resilient outer-conductor bellows, the characteristic impedance of the coaxial connector remains substantially constant, the center conductor taking the form, between the two center-conductor parts, of a resilient center-conductor bellows, the resilient center-conductor bellows being so designed that, if there is a change in the length of the resilient center-conductor bellows, a varying capacitance of the resilient center-conductor bellows is compensated for by an inductance of the resilient center-conductor bellows which varies correspondingly in the opposite direction, in such a way that, if there is a change in the length of the resilient center-conductor bellows, the characteristic impedance of the coaxial connector remains substantially constant.

2. The coaxial connector of claim 1, wherein the first elastic resilient member includes a coil spring.

3. The coaxial connector of claim 1 including a first stop for limiting the movement of the two outer-conductor parts away from one another in the axial direction.

4. The coaxial connector of claim 1 comprising an outer-conductor sleeve which fits around the two outer-conductor parts and which includes second stops to limit axial movement of the two outer-conductor parts away from one another.

5. The coaxial connector of claim 1 including a stop for limiting the movement of the two center-conductor parts away from one another in the axial direction.

6. The coaxial connector of claim 1 comprising having the first center-conductor part movable in the axial direction relative to the first outer-conductor part and the second center-conductor part movable in the axial direction relative to the second outer-conductor part, wherein the center conductor includes a second elastic resilient member which forces the two parts of the center conductor away from one another in the axial direction.

7. The coaxial connector of claim 6, wherein the second elastic resilient member includes a coil spring.

8. The coaxial connector of claim 7 including a stop for limiting the movement of the two center-conductor parts away from one another in the axial direction.

9. The coaxial connector of claim 1 wherein the first elastic resilient member includes a coil spring.

10. The coaxial connector of claim 9 including a first stop for limiting the movement of the two outer-conductor parts away from one another in the axial direction.

11. The coaxial connector of claim 9 comprising an outer-conductor sleeve which fits around the two outer-conductor parts and which includes second stops to limit axial movement of the two outer-conductor parts away from one another.

12. The coaxial connector of claim 9 comprising having the first center-conductor part movable in the axial direction relative to the first outer-conductor part and the second center-conductor part movable in the axial direction relative to the second outer-conductor part, wherein the center conductor includes a second elastic resilient member which forces the two parts of the center conductor away from one another in the axial direction.

* * * * *